United States Patent [19]

Pihl et al.

[11] 4,034,421

[45] July 12, 1977

[54] VACUUM SEWER SYSTEM INCLUDING A COLLECTING TANK

[75] Inventors: Lars Wilhelm Pihl, Bromolla; Lars Bjarne Johansen, Ahus; Carl Göran Herbert Carlsson, Tomelilla; Karl Allan Bonde Mollerstedt, Fjalkinge, all of Sweden

[73] Assignee: IFO AB, Sweden

[21] Appl. No.: 679,422

[22] Filed: Apr. 22, 1976

[30] Foreign Application Priority Data

Apr. 23, 1975 Sweden ..... 7504682

[51] Int. Cl.[2] ..... E03D 1/00; E03D 3/00; E03D 5/00

[52] U.S. Cl. ..... 4/10; 4/77; 4/90

[58] Field of Search ..... 4/10, 11, 9, 8, 12, 4/77, 73, 81, 90, 78, 89, 85; 137/12, 205, 399, 236, 423; 210/15, 152, 173, 259, 350, 356

[56] References Cited

U.S. PATENT DOCUMENTS

| | | | |
|---|---|---|---|
| 3,239,849 | 3/1966 | Liljendahl | 4/77 |
| 3,329,974 | 7/1967 | Belasco et al. | 4/10 X |
| 3,440,669 | 4/1969 | Boestar | 4/10 |
| 3,597,769 | 8/1971 | Brainard et al. | 4/10 |
| 3,628,194 | 12/1971 | Liljendahl | 4/10 |
| 3,686,693 | 8/1972 | Liljendahl | 4/10 |
| 3,733,617 | 5/1973 | Bennett | 4/10 |
| 3,746,032 | 7/1973 | Wallgren | 4/10 X |
| 3,897,600 | 8/1975 | Burkholder | 4/10 |

*Primary Examiner*—Henry K. Artis
*Attorney, Agent, or Firm*—Beveridge, De Grandi, Kline & Lunsford

[57] ABSTRACT

In a vacuum sewer system a tank is provided for the collection of liquid-mixed wastes, especially from water closets, the tank comprising a circulating pump whose inlet and outlet are connected to the tank and which is adapted to circulate the tank contents in a closed path for agitation, comminution and aeration thereof, and a liquid jet pump is inserted in the closed path to establish the necessary vacuum for the sewer system.

7 Claims, 2 Drawing Figures

VACUUM SEWER SYSTEM INCLUDING A COLLECTING TANK

Figure 1:
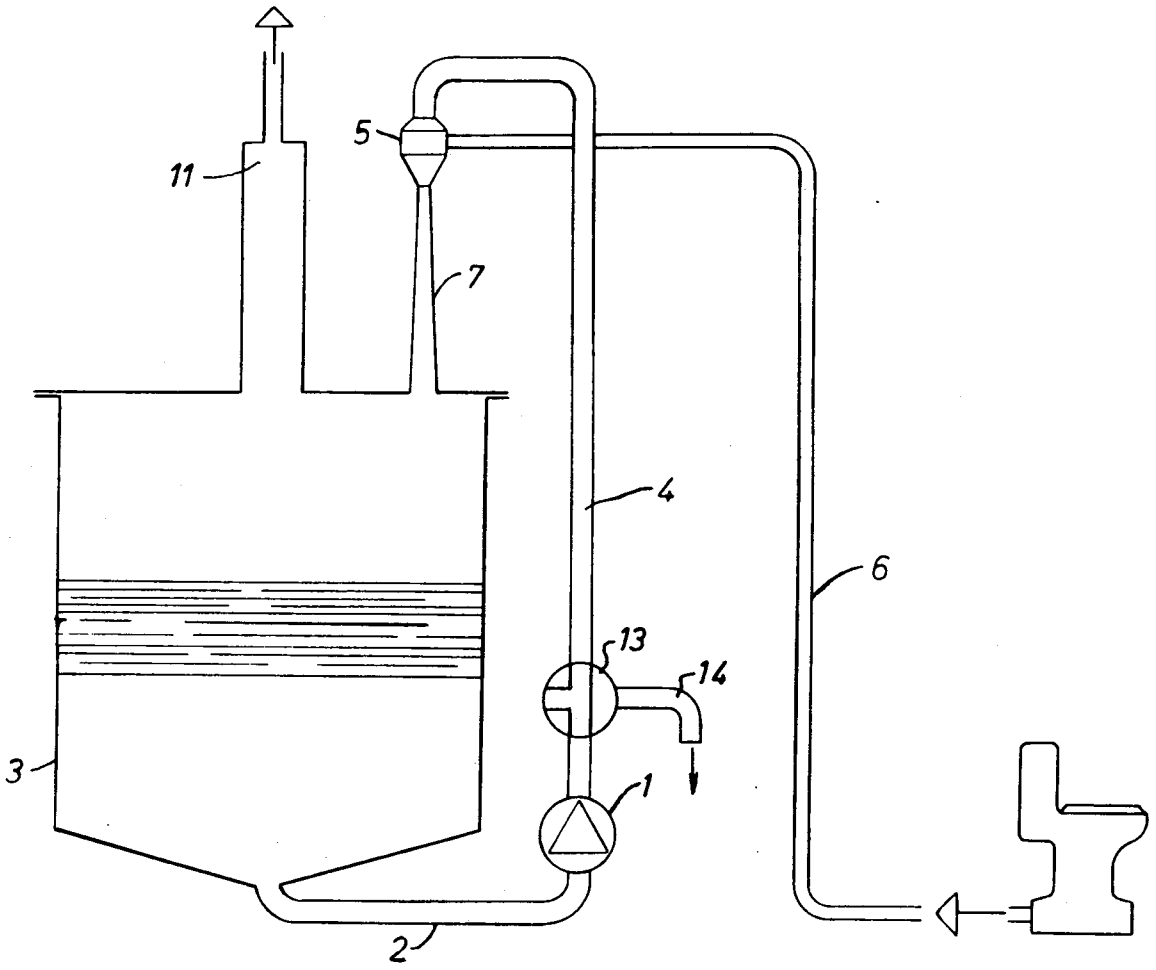

This invention relates to a vacuum sewer system including a collecting tank.

Syphonic type water closets have been known for a long time. The essential advantage of such water closets is that less than 1.5 liter of water is spent in each flushing operation while conventional water closets connected to municipal sewer systems spend about 9 liters in each flushing operation. Because of the insignificant amount of flushing water with which the syphonic type water closets operate it is not permissible to connect them to municipal sewer systems, and these water closets therefore discharge the wastes into collecting tanks in which the requisite vacuum is established by vacuum pumps controlled by means of a vacuum relay. As the feces cannot be aerobically degraded in such tanks they have to be emptied by means of suction pumps. Such an arrangement suffers from obvious disadvantages, and although syphonic type water closets have been known for about twenty years, they have found but very restricted use hitherto for the reasons indicated.

In the last few years, however, there have been developed degradation and decomposition systems which permit combining the use of sparing amounts of flushing water with a total degradation of the wastes discharged from water closets. To empty the collecting tank does not either meet with difficulties as the tank is under atmospheric pressure. However, the combination of a degradation or decomposition system with a syphonic type water closet results in a technically relatively complex installation comprising a vacuum pump and sluices which must be doubled to make a continuous use of the system possible. This in turn makes it necessary to provide control systems so that the sluices can cooperate with each other. Finally, some kind of air supply device is necessary.

Although sluices of the above-mentioned kind might very well be used for removing untreated wastes from syphonic type water closets and for emptying them into conventional sewer systems such a system would not be operative as the insignificant amount of flushing water would not be sufficient as a transportation medium.

Summarizing, we can establish that the hitherto suggested solutions basically are in opposition to the fundamental requirements placed on an installation of this kind, that is simplicity, operational reliability and freedom from maintenance. Besides, the installation costs are relatively high.

The object of the present invention is to provide a vacuum sewer system of the type to which particularly syphonic type water closets are connected, and to eliminate the disadvantages of the prior art systems while retaining the operational reliability thereof.

To this end, a circulating pump is arranged to circulate the contents of the collecting tank for agitation, comminution and aeration thereof, and a liquid jet pump is inserted in the path of circulation of the contents to establish the necessary vacuum for the sewer system.

It has now been found, partly in opposition to prevailing conceptions, that a liquid jet pump can be connected on the pressure side of the circulating pump and that said liquid jet pump by its ejector action can establish the requisite vacuum of a magnitude of 6 m water column or more, and also allows the water and solid constituents discharged from the syphonic type water closet to pass and be carried away. It has also been found that the air sucked into the vacuum conduits upon flushing of the syphonic type water closet is intimately and effectively mixed with the circulating liquid by the action of the liquid jet pump and therefore can be more effectively exploited by the degradation bacteria than finely divided air supplied in conventional manner.

Figure 2:
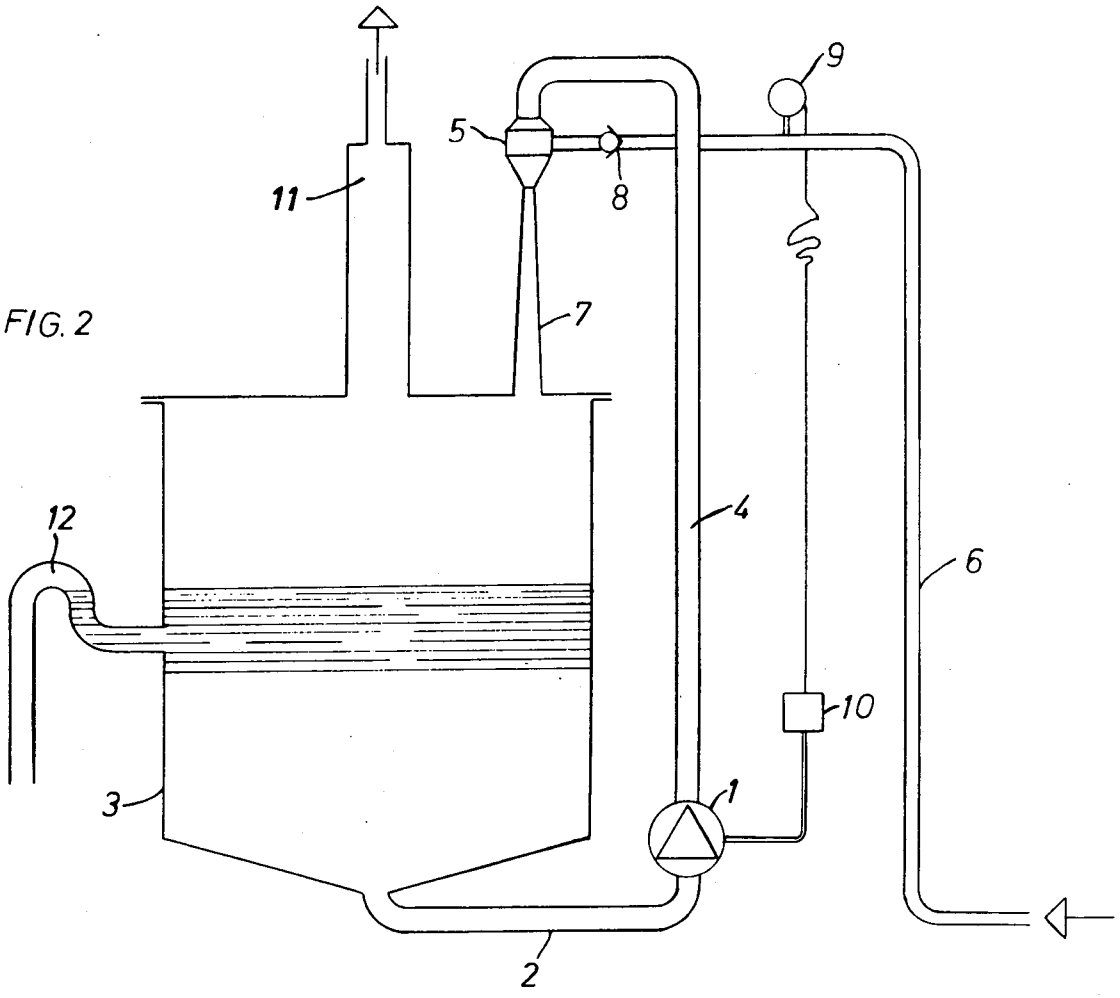

Embodiments of the invention will be more fully described hereinbelow with reference to the accompanying drawings in which FIG. 1 shows an installation including a collecting tank for receiving the wastes discharged from syphonic type water closets, FIG. 2 shows a modified embodiment of the installation in FIG. 1.

FIG. 1 illustrates an installation for the collection of wastes, that is feces, urine, paper and water, from syphonic type water closets (not shown). The installation comprises a circulating pump of the type having a passage or non-cloggable wheels, the pump being driven by a suitable motor. The suction side of the pump 1 is connected via a conduit 2 to a closed collecting tank 3 which is aerated by a venting conduit 11, while the pressure side of the pump is connected via a conduit 4 to a liquid jet pump 5. A diffuser 7 associated with the liquid jet pump 5 extends between the pump and the collecting tank 3. By means of the pump 1 the sludge contained in the collecting tank 3 can be caused to circulate in a path from the collecting tank 3 via conduit 2, circulating pump 1, conduit 4, liquid jet pump 5, diffuser 7 and back to the collecting tank 3. Large solid particles, paper etc., carried along by the sludge are effectively comminuted in the circulating pump 1. Passing through the liquid jet pump 5 the sludge by its speed in the pump outlet establishes a vacuum and via a conduit 6 said vacuum is exerted in the syphonic type water closets. When a syphonic type water closet connected to the conduit 6 is flushed, the feces, urine, paper and water in the water closet will therefore be conveyed in the conduit 6 to the liquid jet pump where said waste matter unites with the sludge circulated by the pump 1. At the flushing of the syphonic type water closet a certain amount of air is always sucked into the vacuum conduit 6 from the water closet and when said air is sucked out through the liquid jet pump the air undergoes an extraordinarily thorough atomisation, resulting in a favourable, very large contact surface between the air and the water.

At its passage through the liquid jet pump 5 having the diffuser 7 the sludge will thus be extremely well oxygenated and besides carbon dioxide will be expelled, which increases the pH-value and prevents evil-smelling hydrogen sulfide ($H_2S$) from escaping.

A prerequisite of the above-mentioned very simple and reliable installation is that the pump is in continuous operation, which may be justified in installations of high flushing frequence. For energy saving purposes it may, however, be advantageous to supplement the installation in the manner shown in FIG. 2. Here, a non-return valve 8 is interposed in the conduit 6, and between said valve and the syphonic type water closets there is provided a sensing means 9 which senses the vacuum in the conduit 6. The sensing means 9 is connected to a switching relay 10 by means of which the motor of the circulating pump 1 can be engaged and disengaged. When the vacuum has reached a predetermined value in the conduit 6 of the installation according to FIG. 2 the sensing means 9 produces a signal which energizes the relay 10 which opens the circuit to the motor of the pump 1. The non-return valve 8 prevents the matter from being sucked back into the conduit 6 which thus retains its vacuum until flushing takes place, when the vacuum in the conduit 6 decreases, the sensing means 9 reacts and a signal from said sensing means via the relay 10 again starts the pump 1 which continues to operate until the vacuum in the conduit 6 has been reestablished.

The collecting tank 3 in FIG. 1 can readily be emptied with the aid of the circulating pump 1. To this end, the out let of the pump is connected by adjustment of a valve 13 to a drain conduit 14. By the comminuting effect of the circulating pump 1 the sludge will be of such a consistency, provided the collecting tank is correctly dimensioned, that biologically non-degraded waste also can be discharged through an overflow 12 (see FIG. 2) into conventional sewer systems with the use of an amount of flushing water less than 1.5 liter.

To reduce the overall height of the installation the liquid jet pump with the diffuser can be submerged in the collecting tank since the requisite vacuum in the vacuum conduit 6 is established also when the outlet of the diffuser is below the liquid surface.

It is also possible to use the collecting tank as a container for propellant liquid, in which case it is provided with means for keeping the liquid level constant, and to connect the suction side of the liquid jet pump to another collecting tank which is under vacuum.

It will be realized that the installation in its simple embodiment is entirely devoid of valves, switching means and the like and does not contain any movable parts other than a circulating pump, which implies that the installation will be extremely reliable in operation, practically free from maintenance and can be manufactured at low cost. Besides, the vacuum-establishing liquid jet pump 5 is of considerably more silent function than a conventional vacuum pump. Also in the embodiment for intermittent operation illustrated in FIG. 2 the installation is extremely simple since the basic design has only been supplemented with a non-return valve and vacuum sensing means including a relay, which are robust and reliable components. A further advantage of the installation according to the invention is that it will function even if the system is inclined or sways, which is important for its use in ships and aircrafts.

What we claim and desire to secure by Letters Patent is:

1. In a vacuum sewer system comprising in combination a. a collecting tank for receiving liquid-mixed wastes, b. a circulating pump with an inlet and an outlet connected to the collecting tank, said circulating pump being adapted to circulate the wastes in said tank for agitation, comminution and aeration thereof, and c. a liquid jet pump, said pump being inserted in said path of circulation to establish the necessary vacuum for the sewer system.

2. A system as claimed in claim 1, comprising a conduit between the suction side of said liquid jet pump and the vacuum sewer system so that wastes discharged from water closets unite in the liquid jet pump with the circulating matter.

3. A system as claimed in claim 2, comprising a. a non-return valve, said non-return valve being inserted in said conduit, b. sensing means adapted to sense the vacuum in the conduit, and c. control means which said sensing means is adapted to actuate and which are arranged to engage and disengage the circulating pump in response to the size of the vacuum in said conduit.

4. A system as claimed in claim 1, in which at least the liquid jet pump is submerged in the collecting tank.

5. A system as claimed in claim 1, in which the wastes in the collecting tank are supplied via an overflow to a conventional sewer system.

6. A system as claimed in claim 1, in which the wastes in said collecting tank are removed from said tank by the circulating pump by switching of the outlet thereof.

7. A system as claimed in claim 1, in which the collecting tank serves as a propellant liquid container and the suction side of the liquid jet pump is connected to another tank under vacuum.

* * * * *